US006819237B2

(12) United States Patent
Wilson et al.

(10) Patent No.: US 6,819,237 B2
(45) Date of Patent: Nov. 16, 2004

(54) AUTOMATED FIRE PROTECTION SYSTEM

(75) Inventors: John E. Wilson, Ridgecrest, CA (US); Matthew L. Boggs, Ridgecrest, CA (US); Howard L. Bowman, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/384,235

(22) Filed: Mar. 10, 2003

(65) Prior Publication Data

US 2003/0230415 A1 Dec. 18, 2003

Related U.S. Application Data

(63) Continuation-in-part of application No. 10/175,533, filed on Jun. 18, 2002.
(60) Provisional application No. 60/300,414, filed on Jun. 20, 2001.

(51) Int. Cl.[7] ..... G08B 1/08
(52) U.S. Cl. ..... 340/539.26; 340/588; 340/589; 89/36.17; 89/41.21; 378/57; 169/46; 252/2; 342/450; 702/153
(58) Field of Search ..... 340/539.26, 539.13, 340/825.36, 589, 588, 331, 332, 600, 691.6, 286.05, 945, 963; 701/213; 702/153; 89/36.17, 37.02, 50, 41.21, 41.01; 244/3.1; 436/155, 156; 378/57; 102/293; 588/202; 342/450; 169/45, 46; 252/2

(56) References Cited

U.S. PATENT DOCUMENTS 5,006,299 A * 4/1991 Gozani et al. ..... 376/159
6,121,882 A * 9/2000 Jaul et al. ..... 340/584
6,189,623 B1 * 2/2001 Zhegrov et al. ..... 169/45
6,380,732 B1 * 4/2002 Gilboa ..... 324/207.17
6,406,918 B1 * 6/2002 Bannister et al. ..... 436/155

* cited by examiner

*Primary Examiner*—Davetta W. Goins
(74) *Attorney, Agent, or Firm*—Charlene A. Haley

(57) ABSTRACT

An apparatus and fire protection system for detecting and extinguishing a spark, flame, or fire on a heat sensitive explosive object, which identifies, locates and relays vital information related to the particular endangered explosive object. The invention can be used to protect any heat sensitive object from thermal damage, explosive or not. Thermal energy activates a power supply, which powers the system, including a plurality of status sensor circuits that determine the status of the source of thermal energy. Each source of thermal energy is individually encoded to relay traits specific to the particular hazardous item, such as cook-off rate, type of energetic material and detonation temperature. Ultimately, all the information from the plurality of circuits and the EEPROM is relayed to personnel via the main system status display board. This permits personnel to become aware of a potential threat and monitor efforts to subdue the threat.

51 Claims, 4 Drawing Sheets

AUTOMATED FIRE PROTECTION SYSTEM

CROSS REFERENCE TO RELATED APPLICATIONS

This application claims priority under 35 U.S.C. §119(e) of U.S. provisional application No. 60/300,414 filed Jun. 20, 2001 and is a continuation-in-part application of U.S. patent application Ser. No. 10/175,533 filed Jun. 18, 2002.

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The field of the present invention pertains to a fire protection apparatus and system for detecting and extinguishing sparks, flames, or fire. More particularly, the invention relates to a fire fighting system for detecting and extinguishing a spark, flame, or fire on a heat sensitive explosive object, which identifies, locates and relays vital information related to the particular endangered explosive object. The invention protects heat sensitive objects, regardless of how they are heated. Throughout the description of the present invention, explosive objects such as bombs and missiles are used to illustrate the use of the invention; however, the invention can be used to protect any heat sensitive object from detonation, thermal damage, explosion, or chemical release of hazardous materials.

BACKGROUND OF THE INVENTION

To prevent fires, and the resulting loss of life and property, the use of flame detectors or flame detection systems are not only voluntarily adopted in many situations, but are also required by the appropriate authority for implementing the National Fire Protection Association's (NFPA) codes, standards, and regulations. Facilities faced with a constant threat of fire, such as petrochemical facilities and refineries, semiconductor fabrication plants, paint facilities, co-generation plants, aircraft hangers, silane gas storage facilities, gas turbines and power plants, gas compressor stations, munitions plants, airbag manufacturing plants, and so on are examples of environments that typically require constant monitoring of potential fire hazard situations.

An environment in which shipboard ordnances were exposed to the threat of detonation occurred on Jul. 29, 1967 on the nation's first carrier, the USS Forrestal. The U.S. Navy was conducting combat operations off the coast of North Vietnam in the Tonkin Gulf on Yankee Station. A Zuni rocket accidentally fired from a F-4 Phantom on the starboard side of the ship into a parked and armed A-4 Skyhawk. The accidental launch and subsequent impact caused the 400 gallon belly fuel tank and a 1,000 pound bomb on the Skyhawk to fall off. The tank broke open spilling JP5 (jet fuel) onto the flight deck and ignited a fire. Within 90 seconds the bomb was the first to cook-off and explode, causing a massive chain reaction of explosions that engulfing half the airwing's aircraft, and blew huge holes in the 3" thick steel flight deck. Fed by fuel and bombs from other aircraft armed and ready for the coming strike, the fire spread quickly and many pilots and support personnel were trapped and burned alive. Fuel and bombs spilled into the holes in the flight deck igniting fires on decks further into the bowels of the ship. The crew heroically fought the fire and carried armed bombs to the side of the ship to throw them overboard for 13 hours. Once the fires were under control, the extent of the devastation was apparent. Most tragic was the loss to the crew: 134 had lost their lives, while an additional 64 were injured.

A fire on the flight deck of an aircraft carrier can quickly become catastrophic due to various types of stored explosive items and heat sensitive objects aboard. The firefighting crew, although highly trained and motivated to control and extinguish the conflagration, can be quickly eliminated in such a scenario because of their proximity to the detonating weapons that cook-off in the fire. This leaves less experienced, and less trained, trying to fight an extremely dangerous fire. It should be noted that a fire is not necessary in order to create a severe fire hazard or explosion in an industrial or military environment. An example of this comes from another aircraft carrier tragedy aboard the USS Enterprise (CVN-65), Jan. 14, 1969. This time, no fire existed prior to the start of weapons cooking-off. Rather, a Zuni rocket, loaded for combat on an F-4 Phantom, was heated until it exploded when the turbine exhaust from an aircraft starter unit (called a "huffer") was inadvertently positioned to blow directly on the weapons warhead. Subsequently, fire broke out when to damaged fuel tanks leaking fuel onto the deck ignited, causing the tragic death of 27 sailors.

Three primary contributing factors to a fire are: (1) fuel (such as JP5 aboard the USS Forrestal); (2) heat derived from jet exhaust or sympathetic detonation; and (3) oxygen. When the fuel is heated above its ignition temperature (or "flash point") in the presence of oxygen, a fire will occur. A fire can self-extinguish if one of the three above mentioned factors is reduced or eliminated. Thus, when the fuel supply of the fire is cut off, the fire typically stops. When a fire fails to self-extinguish, current fire protection systems incorporate flame detectors which are expected to activate suppression agents to extinguish the fire and thereby prevent major damage. It must be noted that the extinguishment of a fire does not remove the explosion hazard when certain industrial and military chemical compounds (such as explosives and propellants) have been heated by the fire that was extinguished. Under such conditions a phenomena known as "thermal runaway" can occur and an explosion can happen even after the device (weapon) has been removed from the fire and cooled. Once a complex chemical compound (like explosives or propellants) reaches its point-of-no-return, no amount of cooling can prevent it from cooking-off. In such cases, it is imperative to know the heating history of the compound in order to gauge when it will explode.

Flame detectors must meet standards set by the NFPA, which are becoming increasingly stringent. Thus, increased sensitivity, faster reaction times, and fewer false alarms are not only desirable, but are now a requirement. Previous flame detectors have many drawbacks. The drawbacks of these previous devices have led to false alarms, which unnecessarily stop production or activate fire suppression systems when no fire is present.

One drawback of the most common types of flame detectors is that they can only sense radiant energy in one or more of either the ultraviolet, visible, near band infrared (IR), or carbon dioxide ($CO_2$) 4.3 micron band spectra. Such flame detectors tend to be unreliable and can fail to distinguish false alarms, including those caused by non-fire radiant energy sources (such as industrial ovens), or controlled fire sources that are not dangerous (such as a lighter). Disrupting an automated process in response to a false alarm can, as noted, have tremendous financial setbacks.

Another drawback of previous fire detectors is their lack of reliability, which can be viewed as largely stemming from their approach to fire detection. The most advanced fire detectors available tend to involve simple microprocessor controls and processing software of roughly the same complexity as those used for controlling microwave ovens. The sensitivity levels of these previous devices are usually calibrated only once, during manufacture. However, the sensitivity levels often change as time passes, causing such conventional flame detectors to fail to detect real fires or to false alarm. In addition, previous fire detectors require a continual source of energy to maintain the fire detection capabilities.

Many of the conventional flame detectors are limited by their utilization of pyroelectric sensors, which only detect the change in radiant heat emitted from a fire. Such pyroelectric sensors depend upon temperature changes caused by radiant energy fluctuations, and are susceptible to premature aging, degraded sensitivity and instability with the passage of time. In addition, such pyroelectric sensors do not take into account natural temperature variations resulting from environmental temperature changes that typically occur during the day, as a result of seasonal changes or prevailing climatic conditions.

Other types of conventional flame detectors identify fires by relying primarily on the ability to detect a unique narrow band spectral emissions radiated from hot $CO_2$ fumes produced by the fire. Hot $CO_2$ gas from a fire emits a narrow band of radiant energy at a wavelength of approximately 4.3 microns. However, cold $CO_2$ (a common fire suppression agent) absorbs energy at 4.3 microns, and can therefore absorb a hot $CO_2$ spike emission generated by a fire. In such situations, conventional $CO_2$-based flame detectors can miss detecting a fire.

Another type of conventional IR flame detector monitors radiant energy in two infrared frequency bands, typically the 4.3 micron frequency band and the 3.8 micron frequency band, while others use as many as three infrared frequency bands. The dual IR frequency band flame detector commonly utilizes an analog signal subtraction technique for subtracting a reference sensor reading at approximately 3.8 microns from the sensed reading of $CO_2$ at approximately 4.3 microns. The triple IR frequency band flame detector uses an analogous technique, with an additional reference band at approximately 5 microns. These types of multi-band flame detectors can produce a false alarm when cold $CO_2$ obscures the fire source between the flame detector, thereby misleading the detector into believing that a strong $CO_2$ emission spike from a fire is detected, when, in fact, a negative absorption spike (caused by e.g., a $CO_2$ suppression agent discharge or leak) has been detected.

Conventional flame detectors using ultraviolet ("UV") sensors also exist, but these have drawbacks as well. Also, because arc welding produces copious amounts of intense ultraviolet energy which can be reflected or transmitted over long distances, UV flame detectors can generate false alarms from such UV energy sources, even when the non-fire UV energy is located at a far distance from the spray booth. Moreover, after deployment, conventional UV detectors eventually can become highly de-sensitized as a result of absorbing smoke from a fire and/or solvent mist, causing the UV detector to become blinded. As a result, UV detectors can provide a false sense of security that they are operating at their optimum performance levels, when, in fact, the facility can be vulnerable to a costly fire.

As an additional disadvantage, UV flame detectors generally require a relatively clean viewing window lens for the UV sensor, and can therefore become blinded or degraded by the presence of paint or oil contaminants on the viewing window lens. Moreover, the sensing techniques utilized with conventional UV detectors usually do not take into account the effects of such types of lens degradation.

In addition to problems with flame detection, many or all-conventional flame detectors have limitations or drawbacks relating to their housing and/or mounting that can affect their performance or longevity, and are being relatively expensive to manufacture. For example, most optical flame detectors have been built with a metal housing made from costly aluminum, stainless steel, or similar materials. Such housings can be heavy, difficult to mount and may not be suitable for certain corrosive environments such as "wet-benches" used in semiconductor fabrication facilities for manufacturing silicon chips and the like.

Further, most or all optical flame detector housings require a window lens (necessary for high optical transmission in the spectral bands used, and are typically made of glass, quartz, sapphire, etc.), but it is usually quite difficult to obtain a tight seal of the window lens to metal housings, particularly in chemical manufacturing, or integrated circuit manufacturing or other applications having extremely rigorous environmental requirements. When the flame detector is not tightly sealed, then corrosive chemicals can leak into the electronic circuitry and degrade or destroy the optical flame detector and housing.

In flame detectors that detect UV energy, the protective window lens must be constructed from highly expensive quartz, sapphire, or other similar material that does not block UV energy.

Moreover, the quartz or sapphire window lenses are typically placed in a metal detector housing which collect dust and contaminants due to the electrostatic effect of the high voltage field (around 300 to 400 volts) used in the UV detectors. To ensure that the UV detector's sensor(s) can "see through" the window lens, complex and costly "through the lens" tests are necessary. To conduct built-in "through the lens" window lens tests, a UV source tube is generally required to generate a UV test signal. Such UV source tubes require a high voltage for gas discharge sources and/or a large current for incandescent sources. Also, UV source tubes are subject to high failure rates. In sum, these self-tests are expensive, require extra power and space, and are prone to breakdowns. It should be noted that the term "fire detector" includes other detectors, such as flame detectors and heat detectors, in the present text and refers generally to any process and/or system for detecting sparks, flames, heat or fires, including that produced by explosive type bombs, missiles, or other dangerous high-energy phenomena.

There is a need for a sensitive, reliable, automated, relatively inexpensive, intelligent, and effective method and system for detecting and extinguishing sparks, flames, or fire which limits the life threatening activity of firefighters and prevents tragedies like the one that occurred on the USS Forrestal.

SUMMARY OF THE INVENTION

The present invention relates to an automated fire protection apparatus and system. Overall, it provides the system parts needed to become aware that a hazardous event exists and manages the hazardous situation to minimize damage to property and life. A preferred embodiment of the present invention discloses a fire fighting protection system. First, the fire protection system includes a means for detecting thermal radiation emitted by a heat source, which also acts as a source of thermal energy. Next, a means for converting the thermal energy from the heat source to electrical energy is either a thermopile or a thermal battery, or both. A means for storing the electrical energy (preferably a capacitor) can be utilized with either a thermopile or optionally with a thermal battery. A thermopile is a thermoelectric device designed to convert a temperature gradient to electrical energy. It essentially uses a series of thermocouple beads to generate voltage. Each thermocouple bead is a junction of dissimilar metals that take advantage of the Peltier Effect. When the thermocouples are connected in series, every other thermocouple are exposed to hot temperatures (and those between the hot junctions exposed to cold temperatures), the effect is that of connecting a bunch of little electrical cells (batteries) in series. The voltage and current response of the thermopile can be manipulated as needed by arranging the thermocouples in arrays of series and parallel loops. The series loops contribute voltage, and the parallel loops contribute current.

The storing means or converting means charges to a specified level initiates a temperature sensor and a transmitter. The transmitter generates a data signal to a means for generating and communicating the data signal according to output from the transmitter. A means for receiving data signals from said transmitter is preferably a receiver and receiver antenna. The means for generating and communicating a signal transmits an omni-directional beacon emitted from the transmitter and produces a location signal. The means for accurately locating the transmitter preferably includes a beacon locator. Additionally, a means for analyzing the location signal and triangulates the location of the heat source(s) preferably is processed by a centralized control system.

A preferred embodiment of the present invention discloses a fire protection apparatus for detecting and responding to a fire. The fire protection apparatus includes a thermal radiation detector, a power supply subsystem converters, (capacitor and/or thermal battery), transmitter, data signal generator and communicator, and at least one location sensor. A thermal radiation detector senses thermal radiation emitted by a heat source, which also acts as a source of thermal energy. A power supply subsystem provides power to the apparatus. In a preferred embodiment, the power supply subsystem comprises a thermal energy to electrical energy converter and a capacitor. A thermal energy to electrical energy converter, such as a thermopile, converts the thermal radiation emitted by the heat source to electrical energy. A thermopile is a device that uses the Peltier effect to generate electrical voltage/current from a temperature difference, or an externally-heated-thermal-battery, a device that generates voltage and current by a chemical reaction that takes place at elevated temperatures. The electrical energy can be stored in an electrical energy storage device (such as a capacitor) at a specified level and then initiate at least one temperature sensor and a transmitter that generates a data signal. When a thermal battery is used as the power supply subsystem it generates voltage and at a specified level, the thermal battery initiates at least one temperature sensor and transmitter that generates a data signal. Charging the capacitor is optional for the thermal battery. A data signal generator and communicator transmit the data signal according to output from the transmitter. At least one beacon locator detects an omni-directional beacon emitted from the transmitter and produces a location signal and a location signal analyzer triangulates a position of each heat source.

Another preferred embodiment of the present invention is a sensor and transmitter device for a fire protection system including at least one status sensor for sensing thermal energy and producing a data signal, at least one converter for converting the thermal energy to electrical energy, at least one controller to process the data signals, at least one encoder to covert input from each the status sensor to a digital output and wherein the digital output is sent to the transmitter, and at least one transmitter for transmitting the data signal from the encoder. The converter is preferably, a thermopile or thermal battery. The controller is preferably a data processor, and the encoder is preferably an RF data link. The apparatus further includes an electrical storage means being a capacitor which is charged by the thermopile or thermal battery An object of a preferred embodiment of the present invention is to provide an inexpensive, durable heat detector that continuously senses the temperature of the heat sensitive object that the present invention is protecting. This detector is mounted upon or within the object being protected and travels with it at all times. In another embodiment, the detector is removable.

Another object of a preferred embodiment of the present invention is to provide an inexpensive, durable encoder and transmitter that sends the output of the heat detector to an automated, computer-based firefighting control system across the hostile environment presented by burning fuel using electromagnetic waves.

Another object of a preferred embodiment of the present invention is to provide an automated, computer-based firefighting control system that interfaces with all vulnerable heat sensitive objects being protected, firefighting components and human operators, so that the system could run autonomously.

Another object of a preferred embodiment of the invention is to provide a mounted, fixed detector/sensor system that is able to locate the object being protected and determine its temperature, heating rate, composition and serial number using inputs from multiple detectors to triangulate actual explosive item(s) location.

A further object of a preferred embodiment of the invention is to provide automated turret-type fire fighting agent applicators and other automated (robotic) firefighting aids that will address the specific concerns and hazards of a given military or industrial environment. These are controlled by the control system to put a cooling stream of water or other agent onto the object of concern, or otherwise eliminate the fire and explosion hazard.

Ordnance-mounted Temperature Sensor Features:

- Powered by a thermal energy to electrical energy converter or a thermal battery
- Determines current temp and heat up rate
- Outputs RF communications signals that may encode:
  - Weapon
  - Configuration (mark/mod)
  - Authentication
  - Temp of detector
  - Calculated heat up rate
  - Calculated total flux absorbed
- Fast—acting—fast response turrets
- Survives in fuel fire and functions reliably long enough to transmit its information to the sensing and locating system and monitor the thermal response of the item to which it is affixed, preferably up to 30 minutes or more.

Ordnance-mounted Power Supply Features:

- Converts thermal energy from fire to electrical energy
- Provides stable, metered DC output for electronics Powers temp sensor electronics and transmitter Small, light, and pliable (conforms to exterior of object to be protected, i.e. a weapons case)

Powers electronics for up to 30 minutes or more from brief exposure to fire

Ordnance-mounted Communications System Features:

Powered by a thermal energy to electrical energy converter or a thermal battery

Transmits data from temp sensor at specified time and/or temperature intervals

Powers transmit antenna

Antenna tuned to operate at elevated temperatures

Transmitter self-tunes output to maximize antenna gain at current antenna temperature Low power—draws mWs—transmits mW—high efficiency Survives fuel fire and transmits reliably for >30 minutes through fire Uses communication method clear of potential interference from fire Uses communication method clear of other electromagnetic spectrum users Hazards of electromagnetic radiation to ordnance (HERO)—safe Sensing and Locating System (Centralized Control System):

Determines transmitting weapon and configuration (mark/mod)

Triangulates exact weapon location

Determines weapons temperature and heat up rate

Calculates time to cook-off

Expandable to control semi-autonomous fire fighting robotics such as automated turrets and/or sacrificial cooler

However, it should be understood that the present invention may be practiced in any environment faced with a threat of intense heat or fire.

DETAILED DESCRIPTION OF PREFERRED EMBODIMENTS

A preferred embodiment of the present invention relates to an apparatus and system for detecting and extinguishing a spark, flame, or fire on a heat sensitive explosive that identifies and locates the particular explosive. More particularly, the present invention involves a sensor and transmitter device mounted on a heat sensitive object so that the location and temperature of the object is determined in a fire or other potentially dangerous environments.

FIGS. 1-4 illustrate preferred embodiments of the system for fire detection and are described in conjunction with an exemplary situation of ordnance on a warship. However, it should be understood that the apparatus and system is effectively utilized in any environment facing a threat from sparks, flames, fire, or chemical release. For example, the system is used in such applications as petrochemical facilities and refineries, semiconductor fabrication plants, co-generation plants, aircraft hangars, gas storage facilities, gas turbines and power plants, gas compressor stations, munitions plants, airbag manufacturing plants, and other energetics facilities.

Figure 4:
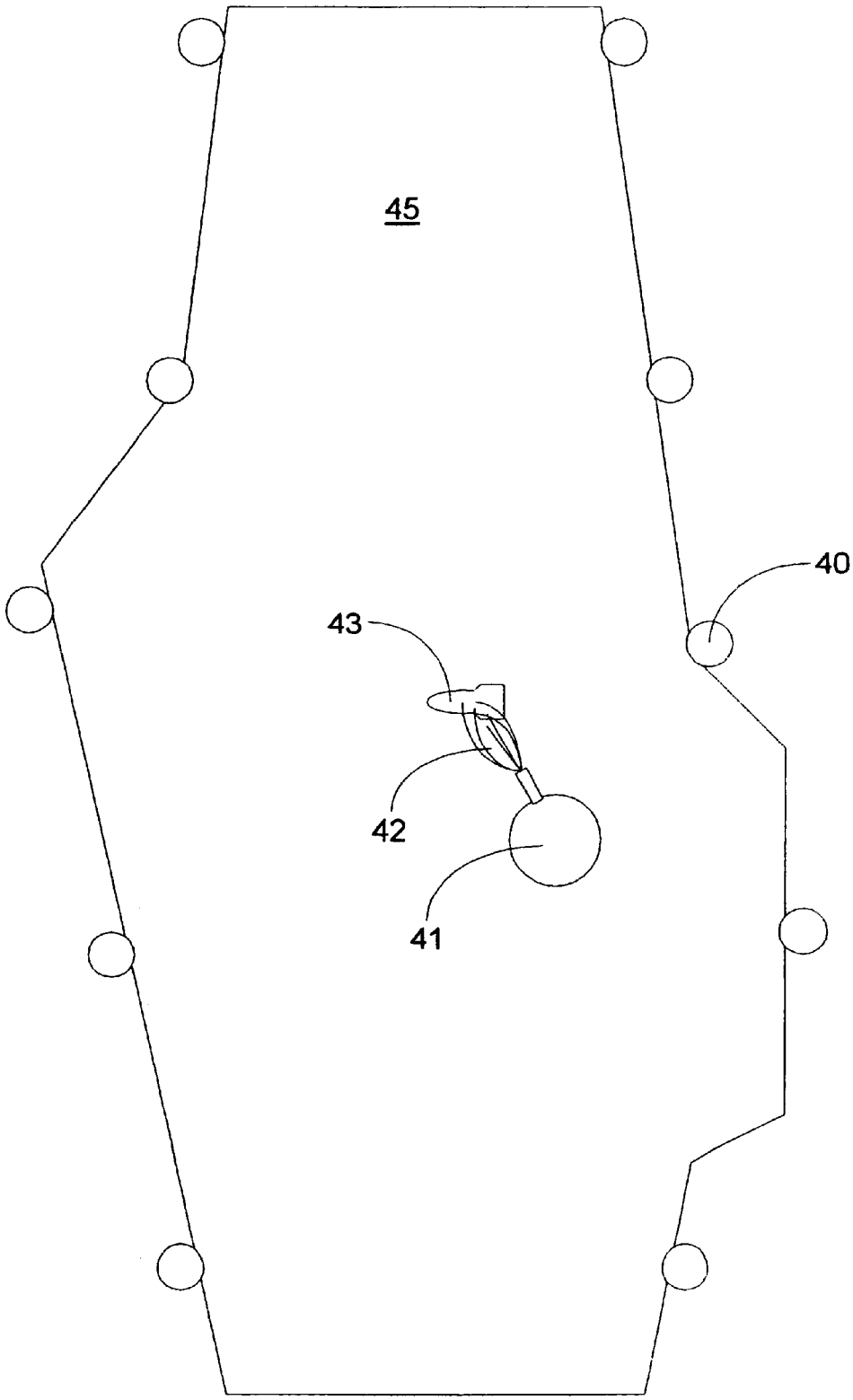
FIG. 4 is an illustration of a preferred embodiment of the fire protection system, which details the coordination of sensors around a potentially hazardous area using either turrets or sacrificial robots according to the present invention.

FIG. 4 illustrates an exemplary environment, for example a flight deck of an aircraft carrier 45, where ordnance 43 or other energetic material is exposed to the threat of detonation. There are several embodiments of the automated system for detecting a heat sensitive object subjected to a hazardous situation and extinguishing the hazardous situation including sparks, flames, fire, or chemical release. One embodiment is an automated, computer-based centralized control system that interfaces with all components and human operators, so that the system is capable of running autonomously. Another embodiment of the present invention includes the automated fire protection system utilizing a sacrificial fire fighting robot which goes to the hazardous situation and protects the heat sensitive object by either extinguishing the hazardous event or cooling the heat sensitive object, or both. In another preferred embodiment, a fixed detector/sensor system 40 provides a means for accurately locating the transmitter (transmission source) which is strategically positioned to locate the ordnance(s) 43 and determine its temperature, heating rate, ordnance type and number control system usingd inputs from multiple detectors, and to triangulate actual object (ordnance) location(s). In still another preferred embodiment, automated turret—type fire fighting agent applicators 41 cover the heat sensitive object of concern 43 with water, aqueous film forming foam (AFFF) or any other type of fire fighting material known in the art. The turrets are controlled by a control system 42 to put a cooling stream of fire suppressant material onto the object of concern 43.

Another preferred embodiment of the present invention includes a sensor and transmitter device attached to or part of the heat sensitive object and used to communicate with the fixed detectors and sensors of the system. A temperature sensor detects any rapid rise in external temperature. The temperature sensor is preferably fabricated using Micro-Electro Mechanical Systems (MEMS) technology; however, any temperature sensor available in the art applicable to the present invention will suffice. The rise in external temperature triggers a broadcast mechanism to begin communicating with fixed detector and sensor system which is preferably automated. As a result, the sensor and transmitter device relays vital information about the endangered ordnance to the fire fighting detector and sensor system. This vital information includes, but is not limited to, current temperature, the rate of temperature increase or decrease at specified intervals, the likely occurrence of the heat sensitive object detonating or exploding (such as linear shaped—charge initiation which would rupture a motor case on an AMRAAM (Advanced Medium-Range Air-to-Air Missile—AIM-120), and the likely initiation/detonation of a primary charge). The automated fire protection system of a preferred embodiment of the present invention provides advanced warning (alarm system) to a fire fighting personnel that an explosion is likely to occur.

Figure 3:
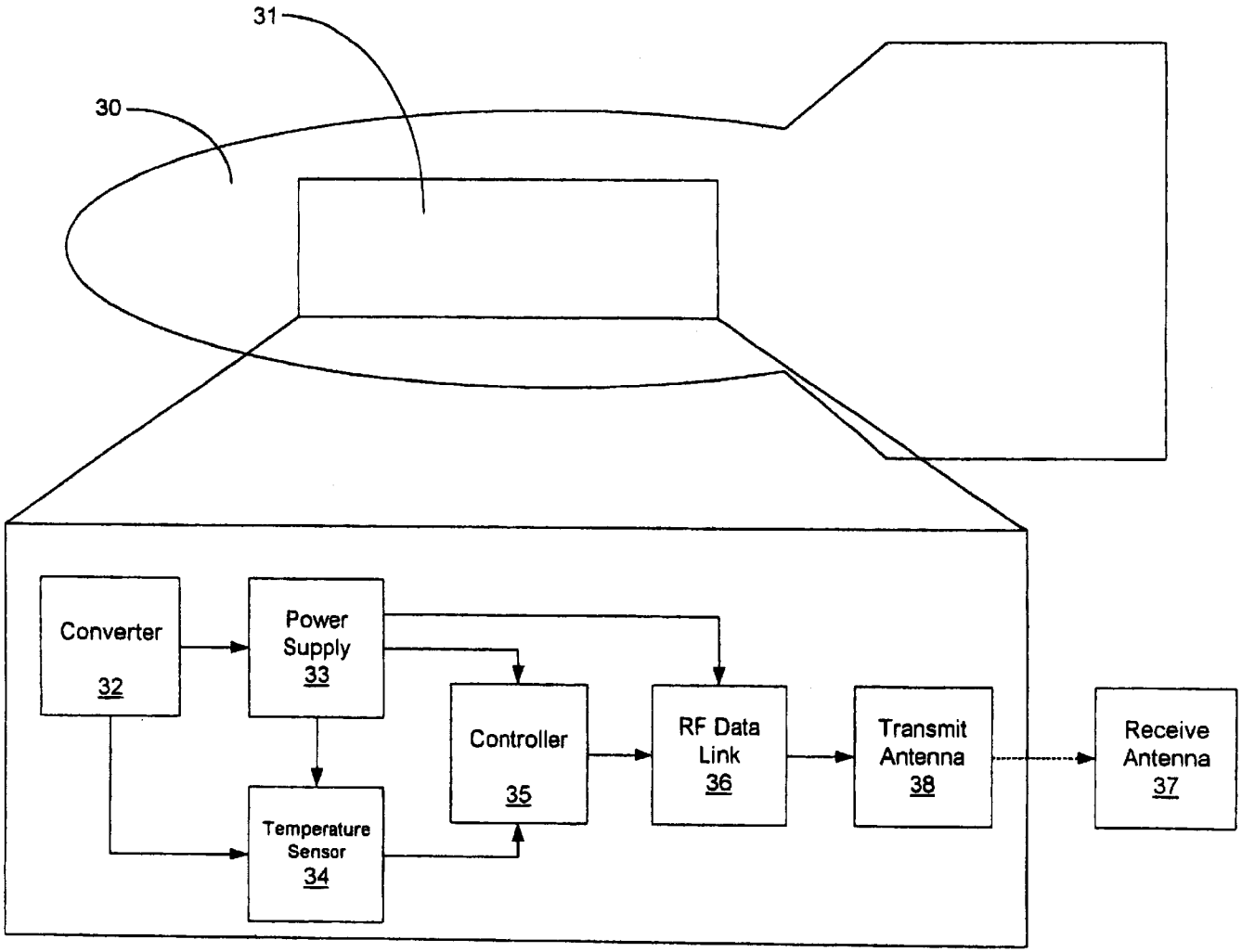
FIG. 3 is an illustration of a preferred embodiment of the fire protection system, which details a fixed sensor and transmitter device mounted on ordnance, such as a missile according to the present invention.

Preferred embodiments of the present invention use either an internal or external sensor and transmitter device. The internal device is engineered into weapon casing or heat sensitive object housing by design. A preferred embodiment includes MEMS temperature sensors in primary charge/motor/warheads or designed as part of the fuse system. In an embodiment within an internal sensor and transmitter device the power comes from a battery designed into the fuse system. In an embodiment with an external sensor and transmitter device it is retro-fitted onto any heat sensitive object that needs to be monitored for hazardous situations. For example, in one embodiment the sensor and transmitter device is printed onto Mylar® (or any other type of thin polyester strip or film) to make a very thin device 31 which is pasted onto the outer case of a bomb or missile 30, as illustrated in FIG. 3. Another advantage of the size and position of the Mylar® sensor and transmitter device when used on an ordnance is that it does not change aerodynamic performance of the bomb or missile. In addition to the described benefits relating to shipboard ordnance, this weapons based temperature sensor is used to alert pilots to any problem with the ordnance temperature during flight and permit jettison of the ordnance(s) before detonation. In a preferred embodiment of the present invention, the ordnance or heat sensitive object is bar coded. The bar code relays information regarding individual characteristics of the endangered ordnance or heat sensitive object such as energetic material, cook off time, and location. However, a bar code can relay any other vital information depending upon the monitored environment.

In another preferred embodiment of the present invention, the Mylar® sensor and transmitter device is conveniently set at various points in a warehouse or other storage facility where the threat of fire creates a hazardous situation to stored heat sensitive objects. The system and apparatus of the present invention is conveniently adapted to use in any building, on a fire truck, on a vehicle, and any other area where a hazardous situation may occur.

To eliminate the need for a continual power supply, in one embodiment the sensor and transmitter device is powered by a thermal energy to electrical energy converter 32, such as a thermopile, that would generate the power needed for the power supply 33, the temperature sensor 34, controller (data processor) 35, encoder (RF data link) 36 and transmit antenna 38. However, in another embodiment a thermal battery is used as a power supply 33. Thermal radiation from the fire generates the power needed to transmit information from the location of the fire to fire fighting personnel. Thermal radiation from the fire drives the thermal energy to an electrical energy converter. Circuitry is inactive until a sufficient heat flux ("sufficient" is defined to depend on the specifications of the heat sensitive object as provided and is defined by the user) is detected to warrant action so no power source is needed until a hazard exists. The hazard (fire) provides the power to the circuitry and begins communicating with the automated fire fighting system.

Figure 1:
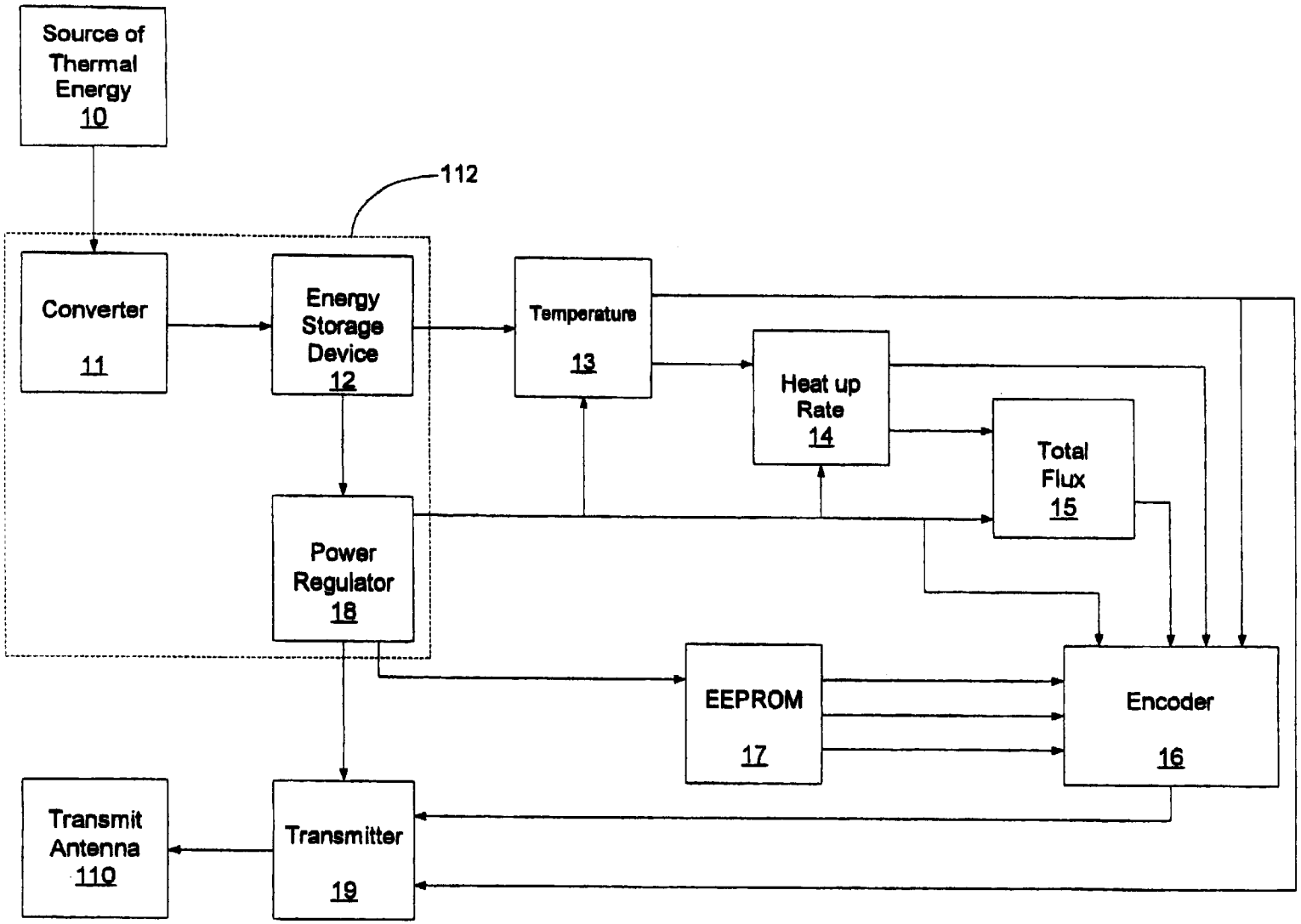
FIG. 1 is an illustration of a preferred embodiment of the fire protection system, which details the sensor/transmitter device placed on, in or near a potential fire hazard according to the present invention.

In a preferred embodiment of the present invention, the operation of the automated fire protection system is illustrated in FIG. 1. When a hazardous situation occurs causing a fire or other heating of an area, the hazardous situation causes the temperature of a heat sensitive object, such as ordnance or energetic material, to rise. A fire or other heating of the area acts as a source of thermal energy 10. Incoming thermal radiation from the rising temperature is detected by a "thermal energy to electric energy converter" 11 which provides a power supply to the broadcast circuitry, activating and initiating communication with the fixed detectors and sensors of the automated fire fighting system. In one embodiment, the electrical energy from the converter 11 charges an energy storage device 12, such as a capacitor. In another embodiment, a thermal battery, depending upon its chemistry, thermal response, and size, optionally utilizes a capacitor. The thermal battery in this embodiment replaces the thermopile and possibly the energy storage capacitor as the power supply source. When a capacitor is utilized as the energy storage device 12 it creates a signal that goes to a plurality of status sensor circuits 13, 14, and 15 within the sensor and transmitter device. These circuits determine the status of the source of thermal energy 10. In a preferred embodiment, the capacitor signal goes to three circuits to determine temperature 13, heat-up rate 14 and total flux 15. Each source of thermal energy 10 is individually encoded by an encoder within the sensor and transmitter device to relay traits specific to the particular ordnance or heat sensitive object, such as cook-off rate and detonation temperature. In a preferred embodiment, the energy storage device (capacitor) 12 is operably coupled to a power regulator. In another embodiment the converter (preferably a thermopile or thermal battery) 11, energy storage device (capacitor) 12, and power regulator 18 comprise the power supply system. The power regulator 18 is coupled to the temperature circuit 13, heat-up rate circuit 14, total flux circuit 15, encoder 16, erasable programmable read-only non-volatile memory (preferably an EEPROM) 17, and transmitter 19 to provide a stable, regulated DC current. Data stored in the EEPROM 17 includes various data regarding the source of thermal energy 10, and heat sensitive object, such as weapon type, configuration, location, authentication, energetic material, cook-off temperature and potential danger. Signals from the plurality of circuits 13, 14, and 15 and the EEPROM 17 are relayed to an encoder 16. The encoder 16 takes all the input signals and converts them to digital output for relay to the transmitter 19. Ultimately, all the information from the plurality of circuits 13, 14, and 15 and the EEPROM 17 is relayed to the sensors and detectors of the system or a central control system status display board 22. In a preferred embodiment, the temperature circuit 13 is coupled to the transmitter 19 for output control. The transmitter 19 automatically tunes output for the greatest antenna gain at a given temperature. In a preferred embodiment, the carrier frequency of the transmitter 19 is varied in relationship to the thermal heating of the transmit antenna 110 to permit the system to operate at peak efficiency. In another preferred embodiment, the transmit antenna 110 tunes itself into the operating band by designing the transmit antenna 110 to operate at peak efficiency at the heated temperature, rather than at the normal ambient temperature. The transmitter 19 is operably coupled to a transmit antenna 110. In a preferred embodiment, the transmit antenna 110 is tuned for operation at high temperature. The transmit antenna 110 relays the signal to the receiver. The transmit antenna 110 also provides the omni-directional beacon 25.

Figure 2:
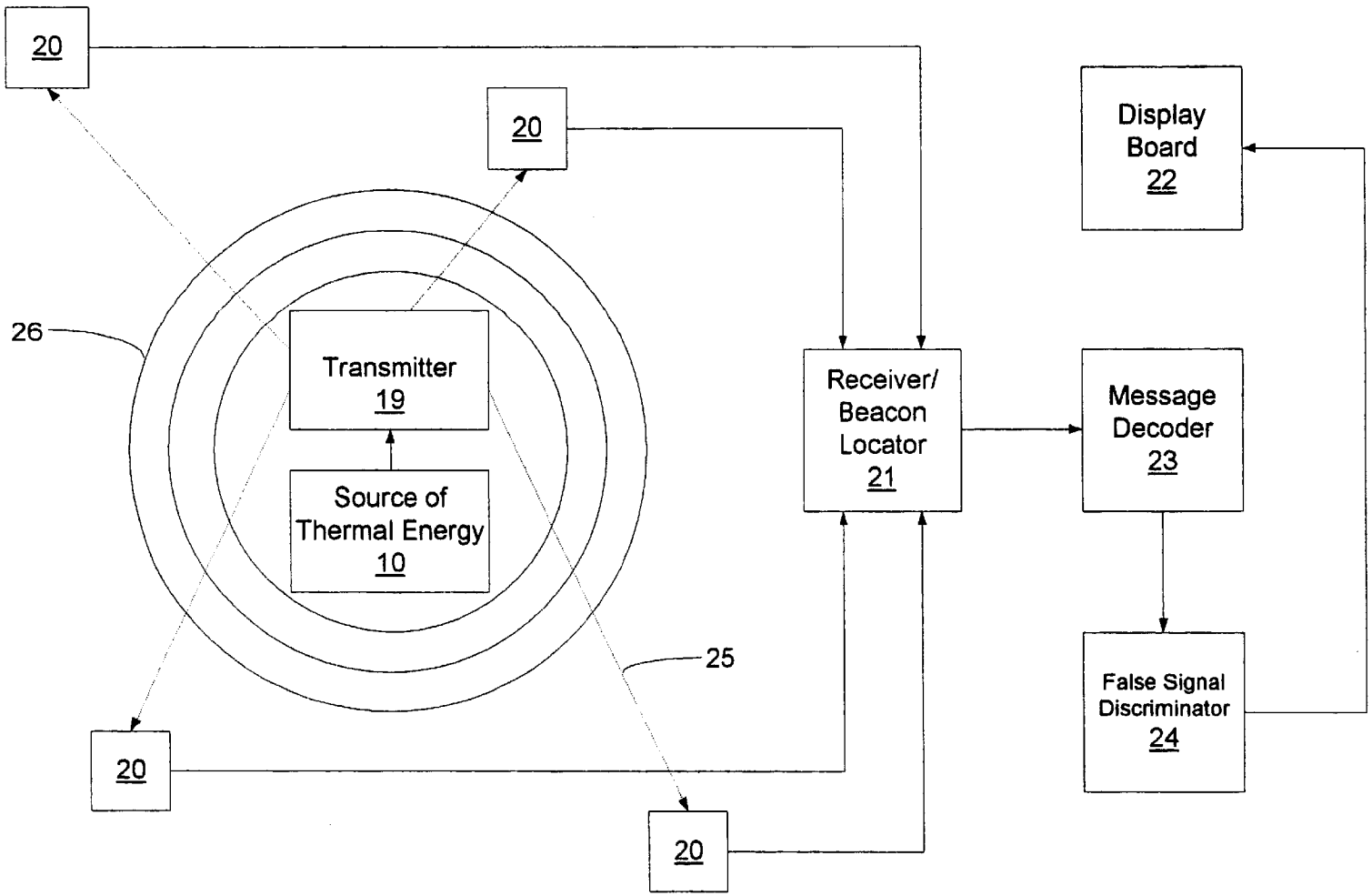
FIG. 2 is an illustration of a preferred embodiment of the fire protection system, which details the triangulation system and the relay of signals to the main system status display board according to the present invention.

Referring to FIGS. 1 and 2, fixed sensors 20 detect omni-directional beacons 25 from the transmitter 19 and transmit antenna 110 of the source of thermal energy 10. The automated fire protection system of the present invention analyzes signals from fixed sensors 20 and triangulates the actual location of the source of thermal energy 10. Each of the fixed sensors 20 includes a receive antenna used to collect the message from the transmitter 19 and transmit antenna 110 and triangulate the exact location of the transmitter 19, which reveals the exact location of the source of thermal energy 10. Each of the fixed sensors 20 transmits a signal to a receiver/beacon locator 21. The message decoder 23 permits the receiver 21 to demodulate the received signal and recover the communications content. A false signal discriminator 24 determines the appropriateness of the receiver 21 through use of a unique coding sequence that is subjected to a correlation procedure to determine probability of false detection. The automated fire protection system continually monitors the vital information, such as temperature, from fixed sensors. The centralized system status display board 22 shows temperature, heat-up rate, total flux absorbed, weapon type and configuration, exact antenna location and any other information specific to the environment (e.g factors in wind, weather, etc . . . ). The centralized display board 22 calculates time to an energetic event and warns of imminent danger. Also, the centralized display board 22 coordinates the automated fire protection system functions which include, but not limited to, an alarm system, fire fighting elements, alerts of imminent dangers, monitors temperature and heat up rates of environment, alarm to evacuate dangerous area, and controls sacrificial robot(s) and/or turrets.

A preferred embodiment of the present invention is a sensor and transmitter device for a fire protection system including at least one status sensor for sensing thermal energy and producing a data signal, at least one converter for converting the thermal energy to electrical energy, at least one controller to process the data signals, at least one encoder to covert input from each the status sensor to a digital output and wherein the digital output is sent to the transmitter, and at least one transmitter for transmitting the data signal from the encoder. The converter is preferably, a thermopile or thermal battery. The controller is preferably a data processor, and the encoder is preferably an RF data link. The apparatus further includes an electrical storage means being a capacitor which is charged by the thermopile or thermal battery.

The automated fire protection system sounds an alarm to notify personnel of the hazard situation or event and the fire fighting procedures of the automated system are simultaneously or soon thereafter deployed. The automated system initiates fire fighting elements, such as fire fighting turrets, which can douse the ordnance location by directing the turrets in the appropriate direction. The fire fighting elements preferably spray cooling water, fire fighting agent or other flame suppressing material onto the ordnance location. In event the weapon broadcast circuitry anticipates a dangerous event such as burning of propellant, shaped-charge breach of weapon case, deflagration or detonation of any charge, the system alerts personnel of impending dangerous event via an alarm system initiated by the centralized display board. The automated system monitors temperatures and heat up rates to estimate passing of point-of-no-return for an explosion and/or chemical release from a motor case or warhead. In the event of any detonation or deflagration, an alarm is sounded to permit safe evacuation of personnel. A preferred embodiment of the automated fire protection system releases control of all turrets that cannot reach the endangered ordnance location. This permits the controller to manually override direct fire fighting resources to alternate concerns. Furthermore, it should be understood that the present invention can be practiced in any environment faced with a threat of intense heat, fire, or hazardous chemical release.

In a preferred embodiment of the present invention, robotic capabilities are added to the automated fire fighting protection system. When the automated system detects endangered ordnance, a fire fighting robot is initiated. Next, the robot locates the endangered ordnance either by the centralized display board system or by its own onboard detection/sensor system. In case of ordnance in fire, the robot drives into the fire, locates bomb and delivers a cooling package to cool and thermally protects the ordnance. The robot locates the heat sensitive objects or hazardous situation autonomously from control of its onboard system or is instructed by remote systems or both. Hot ordnance must be cooled fast and then thermally protected from further exposure to fire. In a preferred embodiment, the robot releases a cooling agent bag onto the ordnance. The cooling agent is a mixture of very cold materials or a mix of insulating media in a cold solution. A preferred example of an applicable cooling agent is a mixture of insulating media and thermally conductive media in liquid nitrogen; however, any other type of insulating media specific to the thermal cooling of the ordnance, heat sensitive object, or hazardous location, will suffice.

The cooling agent layer closest to the ordnance absorbs heat quickly and the outer layer forms a thermally protective coating. The agent preferably includes different materials or media whose particle size varies by layer. A thermally conductive layer can "wick" heat away from a bomb and the thermally conductive layer is on the bottom because it is made of very fine material. Similarly, an insulating layer is made of media of much larger size so that it will "float" on top to form an insulating protection, but is located away from the heat sensitive object so as not to trap the heat in the ordnance to be cooled. This would occur when the conductive material and the insulating material had roughly the same density or when the conductive material were more dense than the insulating material. Medial separation into conductive and insulating layers preferably occurs in the same manner in which larger stones and/or gravel tend toward the top of a pile (in a shaken coffee can, for instance), and sand and dust tend toward the bottom of the pile (or can). Thermally insulating media is preferably composed of gravel-sized chunks of material like fast-block or RTV with glass beads so that it forms an increasingly insulating barrier as the fire grows more intense. The thermally conductive media preferably is composed of a metallic sand like aluminum or copper. The combination of media carried in a delivery container/bag is preferably combined in a homogeneous mixture carried in liquid nitrogen base.

Although the description above contains many specificities, these should not be construed as limiting the scope of the invention but as merely providing an illustration of the presently preferred embodiment of the invention. Thus the scope of this invention should be determined by the appended claims and their legal equivalents.

What is claimed is:

1. A fire fighting protection system, comprising:

means for detecting thermal radiation emitted by a heat source;

means for converting said thermal radiation to electrical energy operably coupled to said means for detecting thermal radiation;

means for providing transmission source(s) wherein first data signals are generated;

means for providing said electrical energy that charges to a specified level which initiates and continuously monitors temperature and temperature changes to at least one status sensor and a transmitter, wherein said transmitter receives said first data signals from at least one said status sensor, and wherein said transmitter generates second data signals;

means for generating and communicating said second data signals from said transmitter, wherein said means for generating and communicating said second data signals further transmits said second data signals from said transmitter;

means for receiving said second data signals from said transmitter;

means for accurately locating said transmitter; and means for analyzing said second data signals, wherein analyzing means triangulates said location of said heat source.

2. The fire protection system of claim 1, further comprising means for cooling each said transmission source according to output from said means for analyzing said second data signals, wherein said cooling means interfaces with said analyzing means.

3. The fire protection system of claim 2, wherein said means for cooling each said transmission source, including a fire fighting agent apparatus is selected from the group consisting of sacrificial robot(s), automated turret system, and manually operated turret system.

4. The fire protection system of claim 2, wherein said means for cooling each said transmission source is continuous to keep said transmission source cool.

5. The fire protection system of claim 1, wherein said means for detecting thermal radiation emitted by a heat source is a thermal radiation detector.

6. The fire protection system of claim 1, wherein said means for converting said thermal radiation to electrical energy is a thermopile or at least one thermal battery.

7. The fire protection system of claim 6, further comprising a means for storing said electrical energy.

8. The fire protection system of claim 7, wherein said means for storing said electrical energy is at least one capacitor.

9. The fire protection system of claim 1, wherein said transmission source is selected from the group consisting of heat sensitive object type, environment temperatures, temperature rise rate, and time tags.

10. The fire protection system of claim 1, wherein said second data signals are transmitted at specific intervals to a centralized control system.

11. The fire protection system of claim 1, wherein said means for generating and communicating said second data signals is a sensor and transmitter device.

12. The fire protection system of claim 11, wherein said sensor and transmitter device includes components selected from the group consisting of a power supply, at least one temperature sensor, at least one transmitter, a controller, encoder, and voltage regulator.

13. The fire protection system of claim 11, wherein said sensor and transmitter device is on a thin film or strip.

14. The fire protection system of claim 12, wherein said controller is a data processor.

15. The fire protection system of claim 12, wherein said encoder is an RF data link.

16. The fire protection system of claim 1, further comprises a centralized control system.

17. The fire protection system of claim 16, wherein said centralized control system operates fire fighting agent apparatuses depending on the information of said second data signals.

18. The fire protection system of claim 1, wherein said means for receiving said second data signals from said transmitter is a receiver and receiver antenna.

19. The fire protection system of claim 1, wherein said means for accurately locating said transmitter is a fixed detector and sensor system.

20. The fire protection system of claim 1, wherein said means for accurately locating said transmitter includes a receiver and beacon locator.

21. The fire protection system of claim 1, wherein said means for analyzing said second data signals includes a plurality of fixed sensor and detectors that analyze said second data signals for triangulating a plurality of second data signals to locate position of said transmission source, analyzing heat sensitive object type and location, analyzing heat sensitive temperature and heat up rate, calculating time to cook-off of heat sensitive object, controlling sacrificial robot(s) and turret(s), controlling amount of fire protection hardware applied to said transmission source, managing a feedback control system to determine whether to continue or cease the fire fighting apparatus, or providing an adaptive control system that analyzes real time data to shift fire fighting resource(s) to another transmission source.

22. The fire protection system of claim 1, further comprising means for generating an alarm, wherein said means for alarm generating and activating said alarm is a centralized control system.

23. The fire protection system of claim 1, wherein said at least one status sensor includes a temperature sensor, wherein said means for storing said electrical energy charges to a specified level then initiates said temperature sensor.

24. The fire protection system of claim 1, further comprising an erasable programmable read-only memory, wherein said erasable programmable read-only non-volatile memory that stores each said data signal information.

25. The fire protection system of claim 24, wherein said non-volatile memory is at least one EEPROM.

26. The fire protection system of claim 12, wherein said encoder converts input from each of said at least one sensor to a digital output and wherein said digital output is sent to said transmitter.

27. The fire protection system of claim 1, wherein said means for generating and communicating said second data signals includes at least one transmit antenna which provides an omni-directional beacon.

28. The fire protection system of claim 2, wherein said means for cooling is at least one turret, wherein said at least one turret sprays said heat source with a cooling agent.

29. The fire protection system of claim 28, wherein said cooling agent is selected from the group consisting of foam, AFFF, water and seawater.

30. An apparatus for a fire protection system, comprising:

a thermal radiation detector, wherein said thermal radiation detector senses thermal radiation emitted by a heat source;

means for converting said thermal radiation to electrical energy operably coupled to said thermal radiation detector;

means to initiate at least one status sensor and a transmitter, wherein said transmitter generates a data signal;

a data signal generator and communicator, wherein said data signal generator and communicator transmits said data signal according to an output from said transmitter;

at least one location sensor and detector, wherein said at least one location sensor detects an omni-directional beacon emitted from said transmitter and produces a location of said signal; and a location signal analyzer, wherein said location signal analyzer analyzes said location signal and triangulates a position of said heat source.

31. The apparatus of claim 30, further comprises an energy storage device, wherein said electrical energy is stored at a specified level then initiates at least one status sensor and a transmitter, wherein said transmitter generates a data signal.

32. The apparatus of claim 31, wherein said energy storage device is at least one capacitor.

33. The apparatus of claim 30, further comprising at least one turret, wherein said at least one turret sprays cooling agent on said heat source according to output from said location signal analyzer.

34. The apparatus of claim 30, further comprises an alarm, wherein said alarm interfaces with a transmitter.

35. The apparatus of claim 33, wherein said cooling agent is selected from the group consisting of AFFF, water and seawater.

36. The apparatus of claim 31, wherein said at least one status sensor including a temperature sensor, wherein said means for storing said electrical energy charges to a specified level then initiates said temperature sensor.

37. The apparatus of claim 32, further comprising a power regulator, wherein said power regulator regulates said electrical energy from a capacitor to provide a consistent direct current.

38. The apparatus of claim 30, further comprising an erasable programmable read-only non-volatile memory, wherein said erasable programmable read-only memory stores heat source information.

39. The apparatus of claim 38, wherein said non-volatile memory is EEPROM.

40. The apparatus of claim 30, further comprising an encoder, wherein said encoder converts input from each of said at least one status sensor to a digital output and wherein said digital output is sent to said transmitter.

41. The apparatus of claim 40, wherein said encoder converts input from each of said at least one status sensor and an erasable programmable read-only non-volatile memory to a digital output and wherein said digital output is sent to said transmitter.

42. The apparatus of claim 30, wherein said data signal generator and communicator said data signal is at least one transmit antenna.

43. The apparatus of claim 30, wherein said thermal energy to electrical energy converter is a thermopile or thermal battery.

44. The apparatus of claim 30, further comprising an alarm, wherein said alarm interfaces with said transmitter and said alarm is activated upon generation of said data signal.

45. The apparatus of claim 30, further comprising a centralized control system having a display board, wherein said display board shows status sensor information and heat source information received from said data signal.

46. The apparatus of claim 30, wherein said fire protection system is automated.

47. A sensor and transmitter device for a fire protection system, comprising: a plurality of transmitters at least one status sensor for sensing thermal energy and producing a data signal;

at least one converter for converting said thermal energy to electrical energy;

at least one controller to process said data signal;

at least one encoder to convert input from each said status sensor to a digital output and wherein said digital output is sent to said transmitter; and each said transmitter having at least one omni-directional beacon, said omni-directional beacon emitted from said transmitter for transmitting said data signal from said encoder.

48. The apparatus in claim 47, wherein said converter is a thermopile or thermal battery.

49. The apparatus in claim 48, further comprising an electrical storage means being a capacitor.

50. The apparatus in claim 47, wherein said controller is a data processor.

51. The apparatus of claim 47, wherein said encoder is an RF data link.

* * * * *